US005852643A

United States Patent [19]

Copson

[11] Patent Number: 5,852,643

[45] Date of Patent: Dec. 22, 1998

[54] FLAK JACKET PROTECTIVE COVER FOR SPENT NUCLEAR FUEL STORAGE CASKS

[76] Inventor: Alex G. Copson, 3419 Dent Pl., NW., Washington, D.C. 20007

[21] Appl. No.: 871,622

[22] Filed: Jun. 9, 1997

[51] Int. Cl.[6] ..... G21F 5/00

[52] U.S. Cl. ..... 376/287; 376/272; 250/517.1; 89/36.02

[58] Field of Search ..... 376/272, 287; 250/506.1, 507.1, 515.1, 517.1; 89/36.02

[56] References Cited

U.S. PATENT DOCUMENTS

| | | | |
|---|---|---|---|
| 4,527,066 | 7/1985 | Dyck et al. | 376/272 |
| 4,532,104 | 7/1985 | Wearden et al. | 376/272 |
| 4,666,659 | 5/1987 | Lusk et al. | 376/272 |
| 4,881,448 | 11/1989 | Medin et al. | 89/36.02 |
| 4,972,087 | 11/1990 | Neider et al. | 250/507.1 |
| 5,059,467 | 10/1991 | Berkovitz | 89/36.02 |
| 5,070,764 | 12/1991 | Shevach et al. | 89/36.17 |
| 5,149,910 | 9/1992 | McKee | 89/36.02 |
| 5,200,256 | 4/1993 | Dunbar | 89/36.01 |
| 5,272,954 | 12/1993 | Crouch | 89/36.02 |
| 5,370,034 | 12/1994 | Turner et al. | 89/36.02 |
| 5,400,688 | 3/1995 | Eninger et al. | 89/36.12 |
| 5,402,703 | 4/1995 | Drotleff | 89/36.02 |
| 5,429,031 | 7/1995 | Merendino | 89/36.02 |
| 5,471,904 | 12/1995 | Martin | 89/36.02 |
| 5,610,363 | 3/1997 | Crews et al. | 89/36.02 |
| 5,633,508 | 5/1997 | Schleppenbach | 250/517.1 |

*Primary Examiner*—Daniel D. Wasil
*Attorney, Agent, or Firm*—Birch, Stewart, Kolasch & Birch, LLP

[57] ABSTRACT

Spent nuclear fuel storage casks, particularly a protective and venting cover for such storage casks which are stored above-ground. The protective and venting cover may be assembled from annular or doughnut-shaped cast concrete members stacked one upon the other. The annuli are axially indexed with respect to the storage cask, such that a venting annulus is formed about the storage cask and the annulus contributes to a defocusing geometry against armor piercing weapons, such as anti-tank "shaped charge" weaponry.

13 Claims, 6 Drawing Sheets

FLAK JACKET PROTECTIVE COVER FOR SPENT NUCLEAR FUEL STORAGE CASKS

BACKGROUND OF THE INVENTION

1. The Prior Art

| | |
|---|---|
| WEARDEN et al. | 4,532,104 |
| LUSK | 4,666,659 |
| NEIDER | 4,972,087 |
| MEDLIN | 4,881,448 |
| McKEE | 5,149,910 |
| ENINGER | 5,400,688 |
| MERENDINO | 5,429,031 |

The foregoing patents are discussed in a PRIOR ART STATEMENT, being filed, separately.

SUMMARY OF THE INVENTION

A flak jacket (or "tea-caddy") protective cover for spent nuclear fuel casks of the type containing spent nuclear fuel rods, and the like. Conventionally, the storage casks are cylindrical iron containers, approximately eight feet in diameter and eighteen feet in heighth. The casks are stored on site at nuclear generating facility, either in a pond or they are stacked above ground. In either case, the vulnerability of the casks to terriorist attack is manifest.

Applicant's flak jacket protective cover is designed for ready encasement of the spent nuclear fuel storage cask as a protection against armor piercing weaponry and the like.

Figure 1:
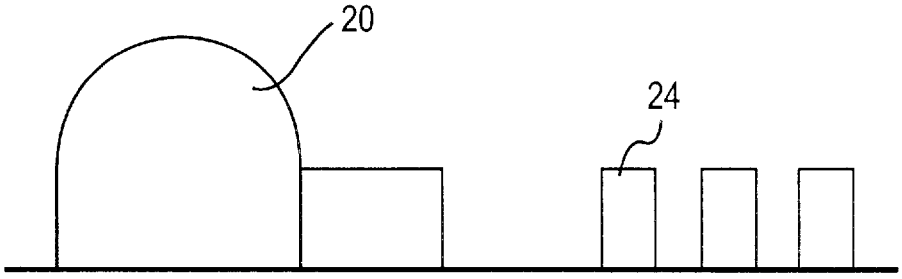
FIG. 1 is an elevational schematic view of a conventional nuclear generation facility with spent nuclear fuel storage casks positioned above-ground and in vulnerable array.

DESCRIPTION OF THE PREFERRED EMBODIMENTS:

In FIG. 1, nuclear generating facility 20 is illustrated with its conventional spent nuclear fuel casks 24, stored adjacently above-ground.

Figure 2:
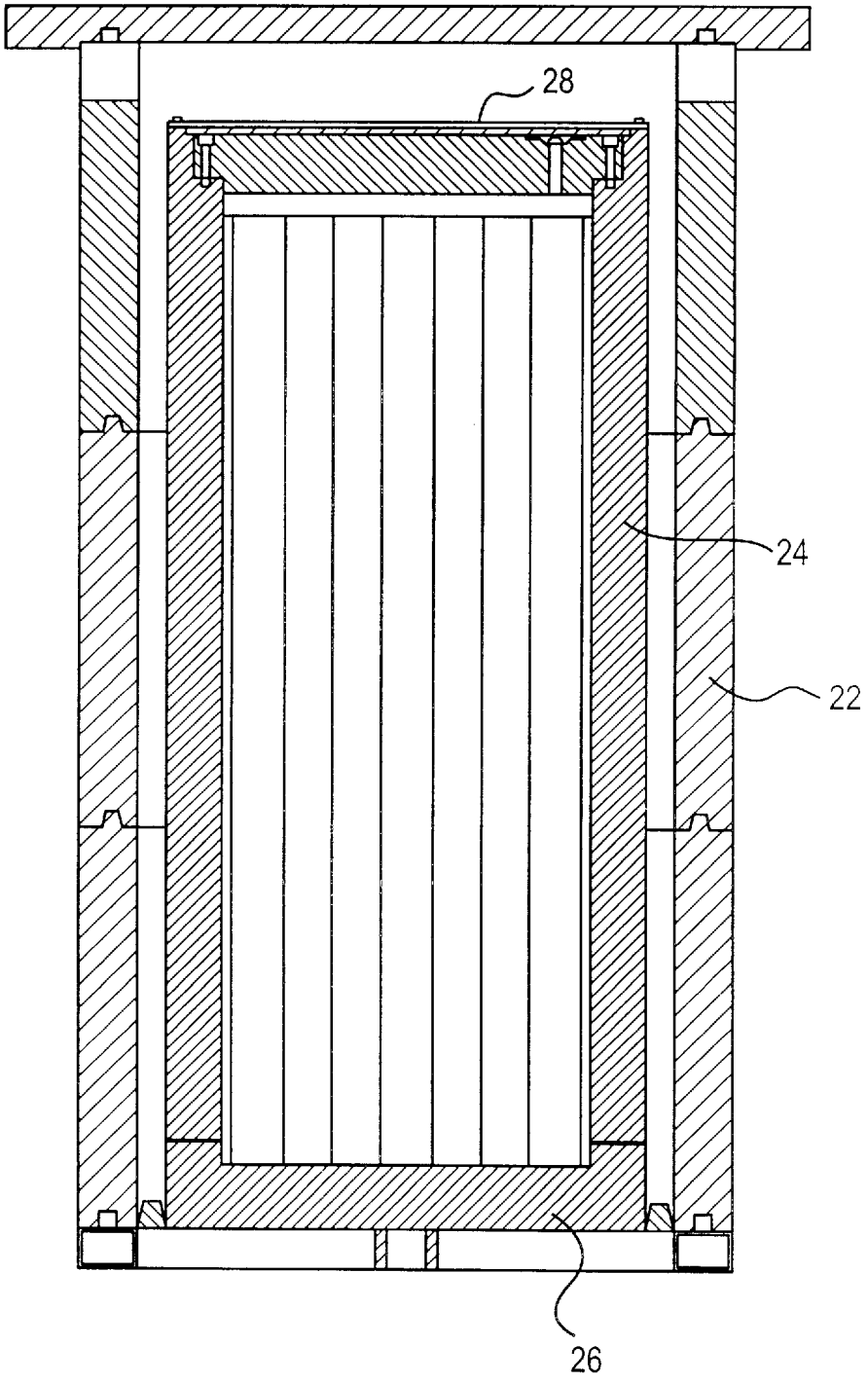
FIG. 2 is a vertical sectional view of a spent nuclear storage fuel cask of the type having venting apertures and manufactured by Gesellschaft Fur Nuklear Services, GmbH of Essen, Germany.

FIG. 2 is a vertical sectional view of a conventional spent nuclear fuel storage cask 24 with top closure 28, including welded plate, and bottom closure 26, enclosed overall by a concrete and ceramic shelter 22.

Figure 3:
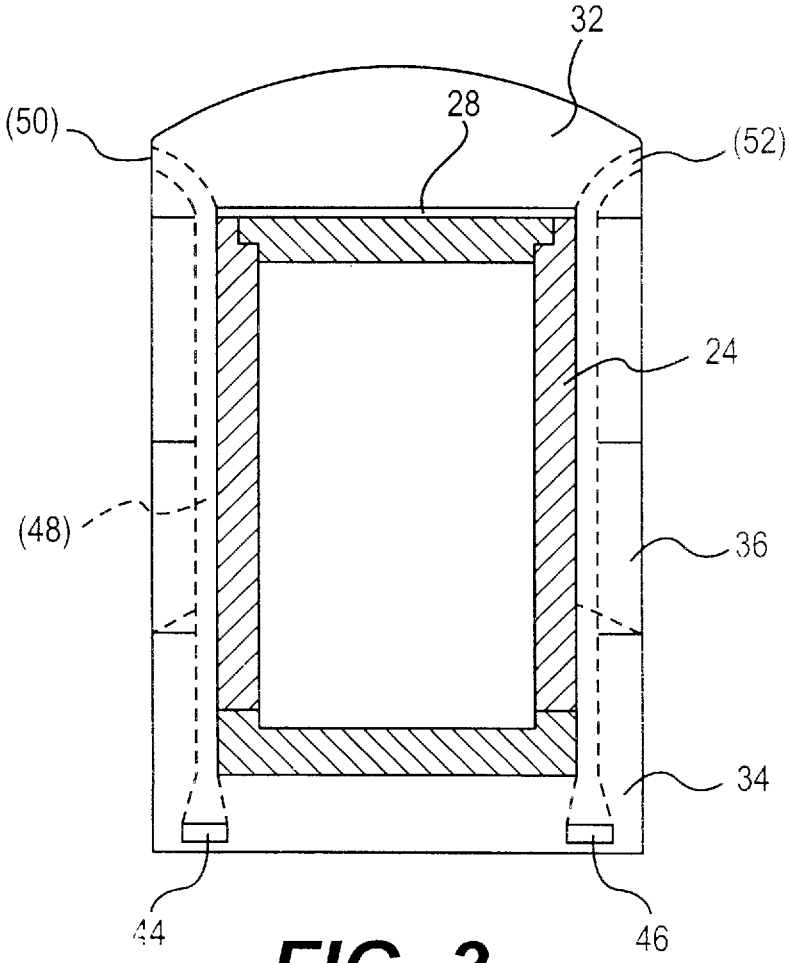
FIG. 3 is a vertical elevation, partially in phantom and in section, showing a proposed flak jacket protective cover comprised of annular or doughnut-shaped base with stackable annular mid-portions and a doughnut-shaped cover enclosing the storage cask.

FIG. 3 is an illustration of applicant's flak jacket protective cover 32 enclosing conventional storage cask 24 with bottom member 26 and welded iron top enclosure 28.

Applicant's flak jacket protective cover 32 is comprised of annular or doughnut-shaped base section 34, a plurality of complementary annular stackable mid-sections 36 and top 38, which has air vents 50, 52. Base 34 may have vents 44,46 communicating with the venting annulus 48 intermediate the doughnut's inner portion and the exterior of cask 24. The venting annulus 48 may be at least 6 inches in lateral width. 10'>15' 10>20".

Figure 4:
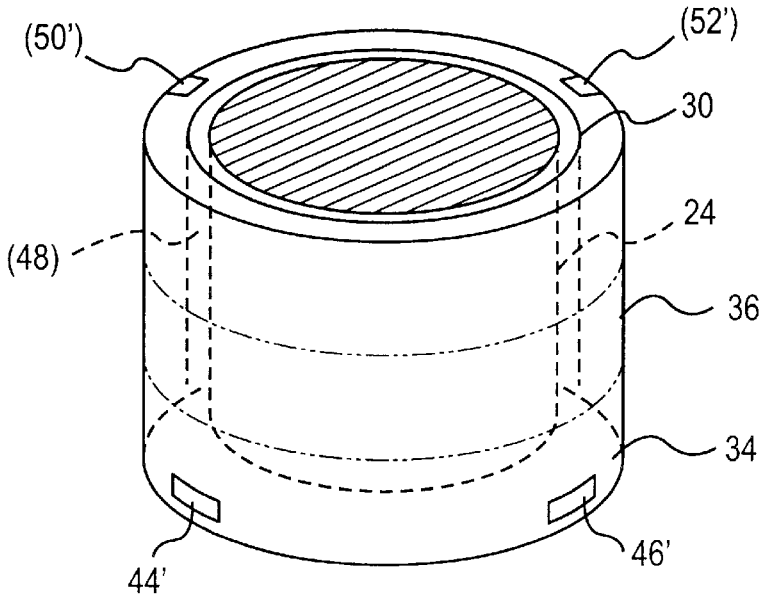
FIG. 4 is a vertical elevation, partially in phantom and in section, showing a modified flak jacket protective cover positioned about an indexing cylinder which in turn is fitted over the spend nuclear fuel storage cask.

In FIG. 4 there is illustrated a modified flak jacket protective cover 32' which is indexed about the storage cask 24 by means of indexing cylinder 30. Doughnut-shaped base section 34' embodies venting ports 44',46', and annular top 32' embodies venting ports 50',52' communicating with venting annulus 48'.

Figure 5:
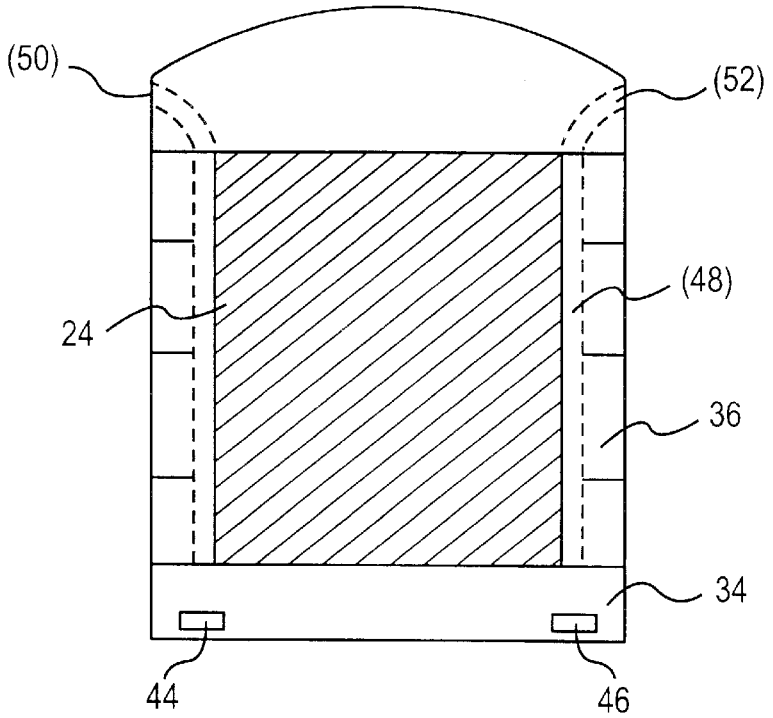
FIG. 5 is a simplified schematic view of the flak jacket protective cover, illustrated in FIG. 3.

In FIG. 5 there is illustrated schematically the FIG. 3 arrangement, where there is full venting of the storage cask 24 exterior by means of vents 44,46 within bottom annular base 34 and vents 50,52 within annular cap 32.

Figure 6:
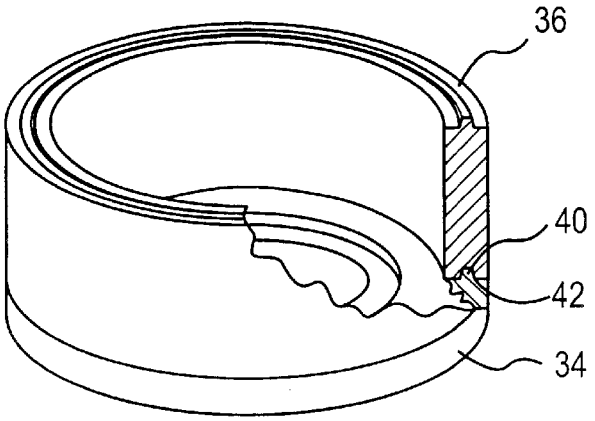
FIG. 6 is an exploded view, partially in phantom and in section, showing the means of fitting the annular mid-portions 36 onto each other and onto the base portion 34 by means, respectively, of a complementary indexing ridge and notch.

In FIG. 6 there is an exploded view of fitting of mid-portion annulus 36 upon annular base 34 by means, respectively, of complemental indexing groove 42 and complemental indexing ridge 40. The remaining mid-portion annulus and top 32 may be similarly indexed to each other.

Figure 7:
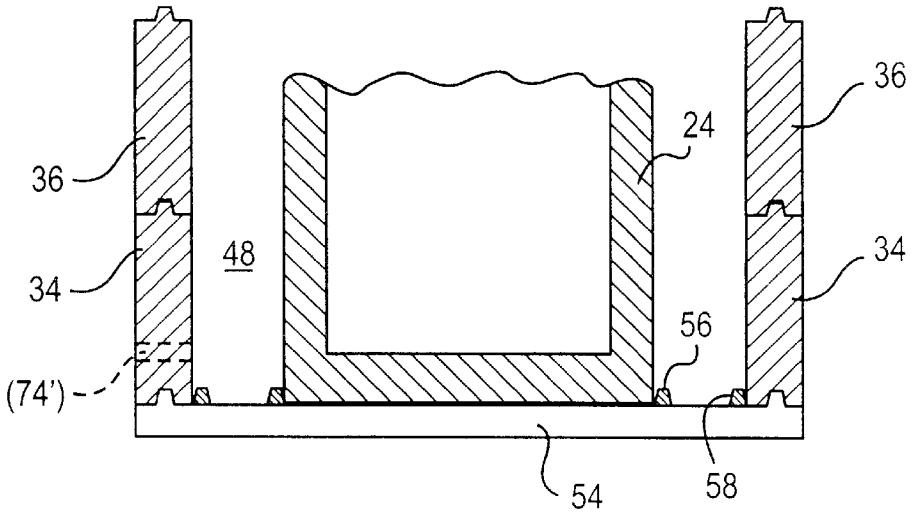
FIG. 7 is a fragmentary elevation, partially in section, showing the fitting of the base and mid-portion annular elements upon an especially adapted support plate with indexing ridges.

In FIG. 7 there is illustrated modified base plate 54 embodying circular indexing ridge 56 for indexing storage cask 24 and circular indexing ridge 58 for indexing annular base member 34.

Figure 8:
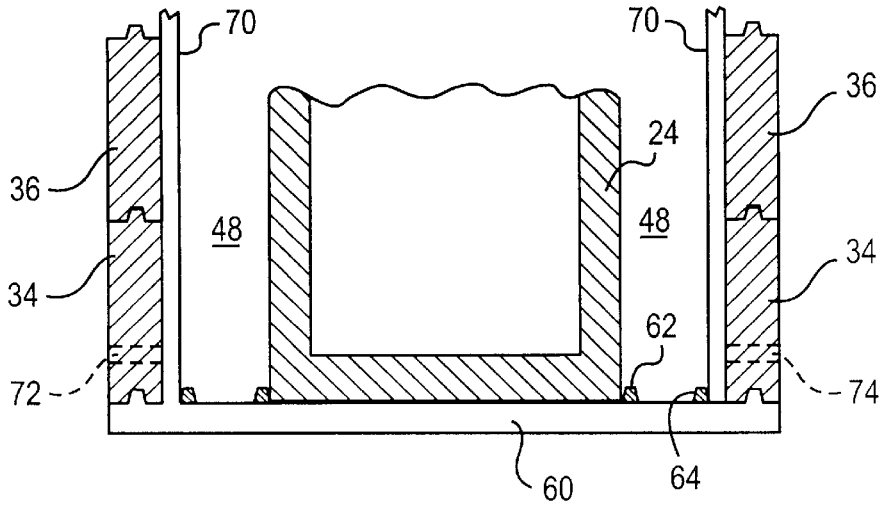
FIG. 8 is a fragmentary elevational view, partially in section, showing a double wall indexing annulus, wherein liquid, sand, cement, or the like, may be pumped into the indexing annulus walls.

FIG. 8 illustrates further modified base plate 60 having inner circular indexing ridge 62 for the storage cask 24 and outer circular indexing ridge 64 for double wall annulus 70 into which cement, sand, water, or the like, may be pumped. Annulus 70 may have lower venting ports 72,74 communicant with venting ports 44, 46 in base annular member 34.

Figure 9:
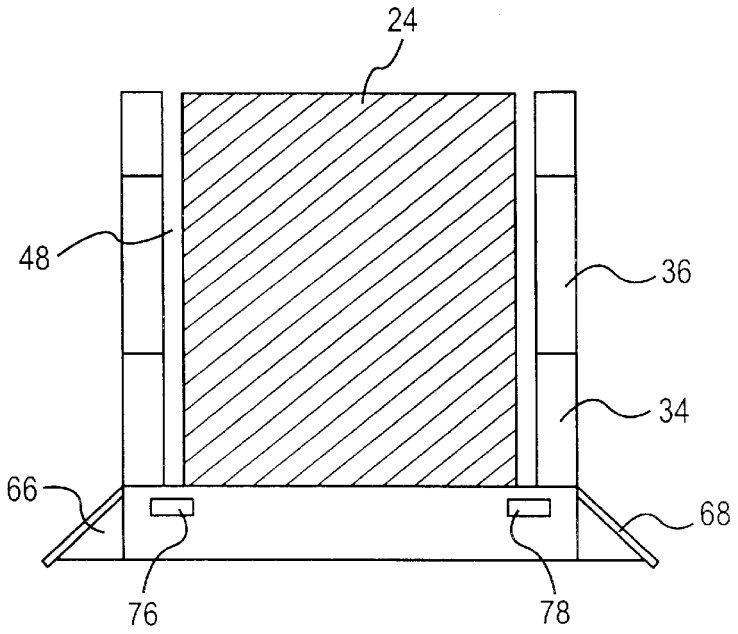
FIG. 9 is a fragmentary elevational view, partially in section, showing the support of the storage cask and the flak jacket protective cover upon a specially adapted base with inclined flange supports and venting ports.
Figure 10:
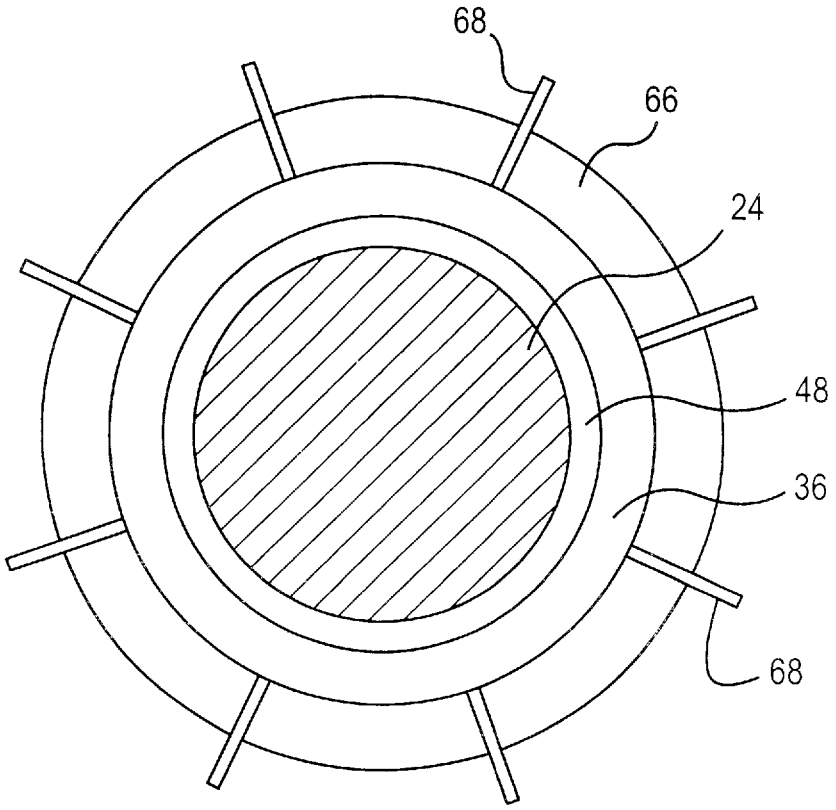
FIG. 10 is a top plan, partially in section, of the modified protective cover and stand illustrated in FIG. 9.

FIGS. 9 and 10 illustrate a further modified and inclined base 66 supported by radially extending leg members 68, such that the flak jacket protective cover 32 and storage cask 24 are supported above a base 66 with full venting through venting ports 76,78.

Manifestly, the cement annuli which may be reinforced with steel bars, or the like, the annular venting annulus and the double wall annulus may be dimensioned for defeating shaped charges, such as used in anti-tank and terrorist weaponry. The protective cover in defeating the armor piercing weaponry thus provides a safeguard against nuclear incident in the event of terrorist attack upon the nuclear power generating facility.

I claim:

1. A flak jacket protective cover for a spent nuclear fuel storage cask of the type having a cylindrical shape, defining a lower portion, a mid-portion and a top portion, with top and bottom closures, said flak jacket protective cover comprising:

an annular base configured to support the cask bottom closure and encircling the lower portion of the cask;

a plurality of complemental annular mid-pieces stacked one upon the other on top of said annular base and encircling the cask mid-portion;

a complemental annular cap supported upon a mid-piece; and an indexing cylinder fitted over the nuclear fuel storage cask, so as to axially index placement of said annular base, annular mid-pieces and annular top, wherein said annular base, annular mid-pieces and said annular cap define an inner venting annulus and a protective and venting cover over the spent nuclear fuel storage cask.

2. A flak jacket protective cover for a spent nuclear fuel storage cask as in claim 1, wherein said indexing cylinder is in the form of a double-walled annulus.

3. A flak jacket protective cover for a spent nuclear fuel storage cask as in claim 1, wherein said annular base, annular mid-pieces and annular top define the inner venting annulus adjacent the storage cask exterior.

4. A flak jacket protective cover for a spent nuclear fuel storage cask as in claim 1, wherein said annular base, said annular mid-pieces and said annular cap are cast concrete.

5. A flak jacket protective cover for a spent nuclear fuel storage cask as in claim 4, wherein the inner venting annulus is at least six inches in lateral width.

6. A flak jacket protective cover for a spent nuclear fuel storage cask as in claim 1, said annular base and said annular cap have lateral vents extending therethrough and into the inner venting annulus.

7. A flak jacket protective cover for a spent nuclear fuel storage cask of the type having a cylindrical shape, defining a lower portion, a mid-portion and a top portion, with top and bottom closures, said flak jacket protective cover comprising:

an annular base configured to support the cask bottom closure and encircling the lower portion of the cask;

a plurality of complemental annular mid-pieces stacked one upon the other on top of said annular base and encircling the cask mid-portion;

a complemental annular cap supported upon a mid-piece; and indexing ridges formed on said annular base for indexing the cask and the annular mid-pieces at a spaced location thereby forming an inner venting annulus between the cask and the annular mid-pieces.

8. The flak jacket protective cover for a spent nuclear fuel storage cask as in claim 7, wherein said annular cap and said annular base include lateral vents extending therethrough and into the inner venting annulus.

9. The flak jacket protective cover for a spent nuclear fuel storage cask as in claim 7, wherein said indexing ridges are two concentric circular ridges spaced apart from each other.

10. The flak jacket protective cover for a spent nuclear fuel storage cask as in claim 7, wherein said annular base, said annular mid-pieces and said annular cap are cast concrete.

11. The flak jacket protective cover for a spent nuclear fuel storage cask as in claim 7, wherein the inner venting annulus is at least six inches in lateral width.

12. The flak jacket protective cover for a spent nuclear fuel storage cask as in claim 7, wherein said annular base includes a surface for supporting the storage cask and the annular mid-pieces thereon and the indexing ridges are raised from the surface of the annular base.

13. The flak jacket protective cover for a spent nuclear fuel storage cask as in claim 12, wherein the indexing ridges comprise a first indexing ridge located at an edge of the cask and a second indexing ridge located at an edge of a bottom annular mid-piece for locating the cask and the bottom annular mid-piece thereon, respectively.

* * * * *